United States Patent [19]

Brame

[11] Patent Number: 4,864,698

[45] Date of Patent: Sep. 12, 1989

[54] QUICK RELEASE HOOK AND LOOP FASTENER

[76] Inventor: William D. Brame, P.O. Box 1071, Bellflower, Calif. 90706

[21] Appl. No.: 208,293

[22] Filed: Jun. 10, 1988

[51] Int. Cl.[4] ..... A44B 18/00

[52] U.S. Cl. ..... 24/442; 24/16 PB; 24/450; 128/DIG. 15

[58] Field of Search ..... 24/442, 306, 16 R; 128/DIG. 15, 327; 248/205.2; 297/DIG. 6; 2/DIG. 6

[56] References Cited

U.S. PATENT DOCUMENTS

| | | | |
|---|---|---|---|
| 3,279,008 | 10/1966 | Wallach | 24/16 PB |
| 3,372,438 | 3/1968 | Rinecker | 24/450 |
| 3,747,171 | 7/1973 | Montague, Jr. | 24/442 |
| 3,940,873 | 3/1976 | Lawless | 24/442 |
| 4,149,540 | 4/1979 | Hasslinger | 128/327 |
| 4,273,130 | 6/1981 | Simpson | 128/DIG. 15 |
| 4,706,914 | 11/1987 | Ground | 24/447 |

OTHER PUBLICATIONS

New Tape Tote Tape Dispensing System Prive List; one sheet, no date.

New Tape Tote Tape Dispensing System Copyright 1987 Tape Mate; one sheet.

*Primary Examiner*—Victor N. Sakran

*Attorney, Agent, or Firm*—Charles H. Thomas

[57] ABSTRACT

An improvement is provided for a releasable, flexible fabric hook and loop fastener having a pair of strap ends which are adapted for mutually releasable interengagement to form a loop when disposed in facing, overlapping arrangement in contact with each other. According to the improvement, the contact surface on the innermost of the strap ends does not extend to the extremity of the strap end, but terminates short of it, thereby defining a tip which is not engageable with the contact surface of the outermost strap end. When the outermost strap end is peeled away from the innermost strap end, the tip on the innermost stap end allows the contact surfaces to separate cleanly so that the fastener can be opened with one hand.

1 Claim, 2 Drawing Sheets

QUICK RELEASE HOOK AND LOOP FASTENER

BACKGROUND OF THE INVENTION

1. Field of the Invention

The present invention is directed to an improvement in a releasable flexible fabric hook and loop fastener which has strap ends releasably engageable with each other to form a loop.

2. Description of the prior art

Releasable, flexible fabric hook and loop fasteners have been commercially available for many purposes for quite some time. Such hook and loop fasteners form releasable closures having mutually engageable contact surfaces, one of which bears a multiplicity of projecting flexible hooks, typically formed of nylon or other plasticized fabric. The other contact surface bears a flexible, looped pile. The contact surfaces are positionable in juxtaposition in an overlapping relationship, whereupon the hooks become releasably engaged in the pile. Such releasable fasteners have been sold for many years under the registered trademark Velcro and are described, for example, in the following U.S. Pat. Nos. 2,717,437; 3,009,235; 3,241,881; 3,313,511; 3,027,566; 3,338,291; 2,976,914; 3,328,081; 3,485,529; and 3,279,008, as well as many others.

While flexible hook and loop fasteners have been employed in many different applications, one very versatile fastener has a pair of strap ends which extend from a central region that is secured to some base object The strap ends are disengageable from each other and are constructed with hook and loop contact surfaces thereon, of the type described. The free strap ends are adapted for mutually releasable interengagement to cooperatively form a loop when disposed in facing, overlapping arrangement in contact with each other.

Such a loop may be utilized in any number of different ways. For example, the loop may be anchored at an intermediate location between the free ends to some base structure, and the free ends may be utilized to releasably secure articles in position relative to the base structure. Tools may be releasably held on a mounting board or in a tool kit in this manner. Likewise, medical instruments may be removably held against the surface of an instrument kit. Luggage may be held in position within an enclosure in the same fashion. Innumerable other applications exist where the free ends of fabric hook and loop straps are releasably secured together to form an encircling or encompassing loop.

Although fabric hook and loop encircling straps have been used in the foregoing manner for many years, one problem which has persisted has been the inability to quickly separate the straps using only one hand. When strap ends are releasably engaged together, an inwardly facing contact surface on an outermost strap is disposed in contact with an outwardly facing contact surface on an innermost strap. The outer strap overlaps the inner strap throughout an area of mutual contact between the contact surfaces. The resilient hooks are releasably embedded in the loops of the pile, thereby holding the strap ends in overlapping contact with each other to maintain an enclosing loop.

While the force with which the strap ends are held together is quite significant in the aggregate, the strap ends can be separated relatively easily by merely gripping the exposed tip of the outer strap and peeling it back from the inner strap, thereby separating the mutually engaged hooks and loops bit by bit. However, where both the inner and outer strap ends are free and unconstrained, the inner strap will tend to follow the outer strap in the direction in which the outer strap is pulled. Consequently, in many instances the outermost strap will be pulled taut against the location at which the intermediate portion of the loop is anchored to a base structure before separation from the innermost strap occurs. As a result, total separation of the strap ends is not achieved by merely peeling the outer strap. Instead, it is necessary to seize the inner strap and prevent the tip of the inner strap from being carried with the outer strap as the outer strap is peeled back. Total separation of the strap ends is thereby achieved, but only through the use of two hands.

In many situations it is desirable to totally separate the overlapped ends of fabric hook and loop fastener straps quickly while using but a single hand, as the other hand of the user may be occupied with other matters. For example, it is highly desireable for a physician to be able to open the strap ends of a flexible fabric hook and loop fastener using the fingers of a single hand, in order to remove a medical instrument from an instrument case, thereby freeing the physician's other hand. Numerous other situations exist in which it is likewise desirable to quickly and easily separate the interengaged free strap ends of a hook and loop fabric fastener formed into a loop or ring using the fingers of a single hand However, the construction of conventional hook and loop fastener strap ends is such that complete separation cannot be achieved in this manner.

SUMMARY OF THE INVENTION

A primary object of the present invention is to provide an improvement to a releasable fastener employing fabric hook and loop fastening elements on the ends of a pair of free straps. With the improvement of the invention the interengaged strap ends can be completely separated from each other by merely peeling back the end of the outer strap from an initial position of overlapped interengagement with an inner strap.

According to the improvement of the invention the contact surface on the outwardly facing side of the inner strap end in a pair of overlapped strap ends terminates short of the extremity of the inner strap end adjacent a tip thereof. The terminus of the free extremity of the inwardly disposed strap, adjacent to the contact surface thereon, is not engageable with the contact surface of the other strap. Instead, the extremity of the end of the inner strap is formed as a tip, normally having a relatively smooth surface, but which in any event is not engageable by the contact surface of the outer strap end juxtaposed thereagainst. The contact surface on the inner strap preferably extends no closer to the extremity of that strap than a distance of about one quarter of an inch. Thus, the terminus or tip of the free extremity of the inner strap is at least a quarter of an inch wide.

When the outer strap in a flexible fabric hook and loop fastener improved according to the invention is peeled back from the inner strap, the extreme end of the tip of the inner strap is pressed against the inwardly facing contact surface of the outer strap. The tip thereby acts as a very short lever which aids in prying apart the last remaining mutually engaged hooks and loops of the contact surfaces. Accordingly, a hook and loop fastener improved according to the invention can be quickly and easily opened with the fingers of a single hand, consistently and without the necessity for constraining movement of the inner strap end with the other hand.

The improvement of the invention is equally applicable regardless of the arrangement of the mating hook and loop fastener closure elements on the inner and outer straps. That is, the improvement of the invention is applicable to a releasable fastener in which the contact surface of the inner strap end bears the flexible hooks and the contact surface of the outer strap end bears the looped pile. Conversely, the invention is equally applicable to a fastener in which the contact surface of the outer strap end bears the flexible hooks and the contact surface of the inner strap end bears the looped pile.

Preferably, the tip or terminus of the inner strap in a releasable fastener improved according to the invention is slightly stiffer than the immediately adjacent structure of the strap. The necessary stiffening effect can be conveniently and easily achieved by merely folding over the transverse edge extremity of the interior strap to form a short tip region of double thickness This fold may be permanently maintained by stitching, adhesive, rivets, or by some other means.

In the preferred embodiments of the invention the extremity of the outer strap forms a gripping tab. This also may be achieved by merely folding over the transverse edge of the outer strap and stitching through the double thickness produced, or by applying adhesive to the surfaces which are to be folded together, prior to creating the fold. The provision of a gripping tab on the outer strap end further facilitates opening the closure utilizing the fingers of a single hand, since the gripping tab can easily be seized between a thumb and forefinger.

In one broad aspect the present invention may be considered to be a releasable fastener having inner and outer strap ends releasably securable together to form an encircling loop and wherein the inner strap end has an outwardly facing contact surface which terminates short of the extremity of the inner strap end adjacent a tip thereof. The outer strap end has an inwardly facing contact surface. One of the contact surfaces bears a multiplicity of projecting, flexible hooks and the other of the contact surfaces bears a flexible, looped pile. The contact surfaces are positionable in juxtaposition whereby the hooks are releasably engageable in the pile.

The invention may be described with greater clarity and particularity by reference to the accompanying drawings.

DESCRIPTION OF THE EMBODIMENTS

Figure 1:
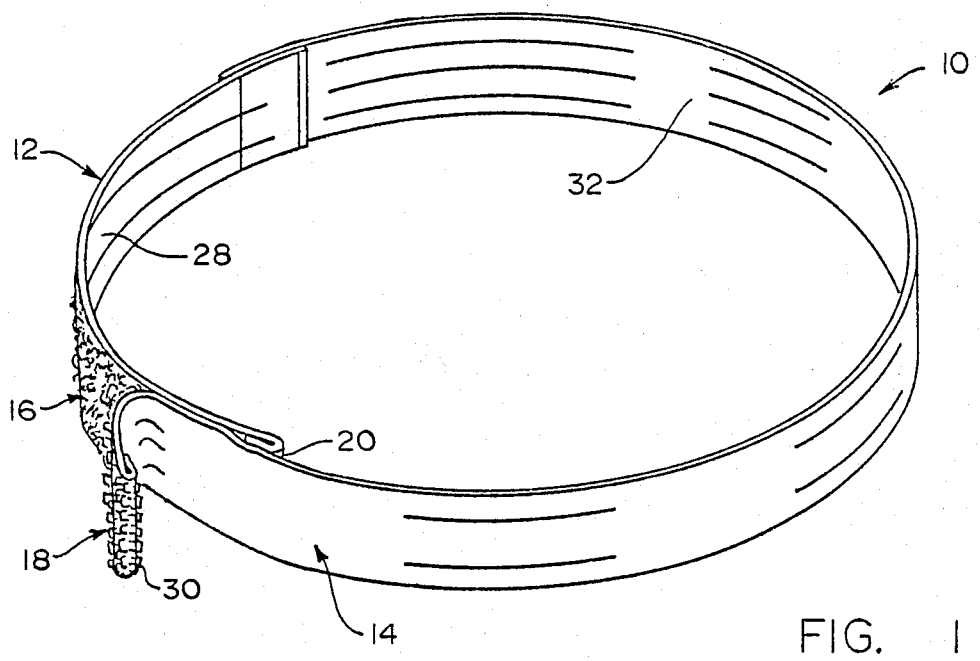
FIG. 1 is a perspective view of one embodiment of a releasable fastener according to the invention having strap ends that form an encircling loop.
Figure 2:
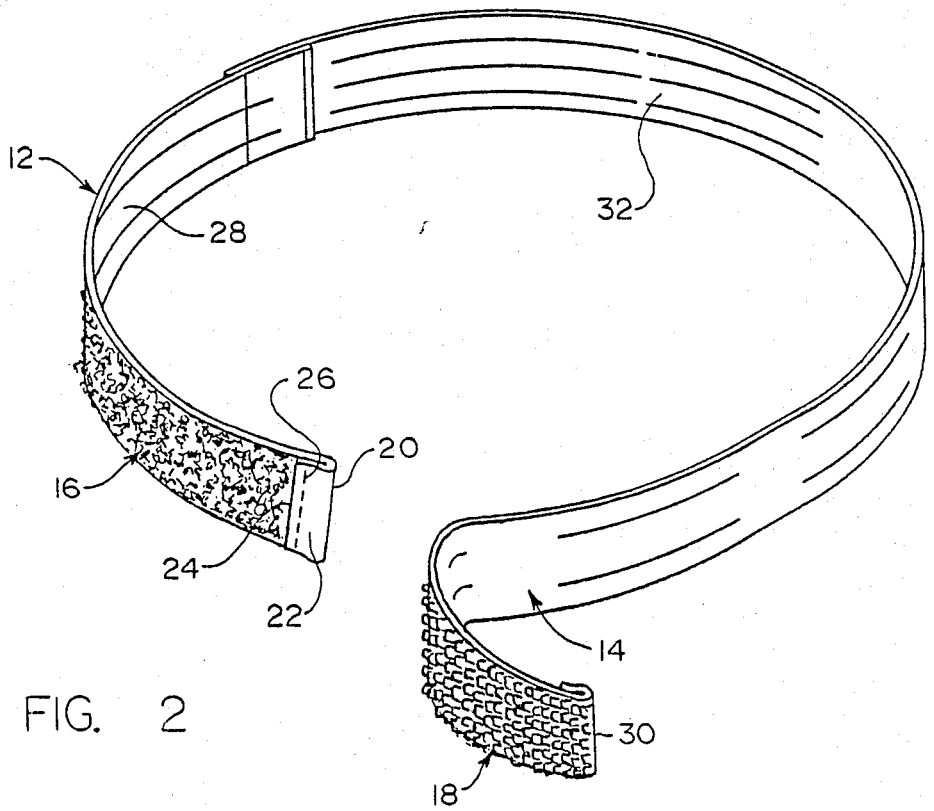
FIG. 2 is a perspective view showing the ends of the releasable fastener of FIG. 1 completely separated.

FIG. 1 illustrates a releasable flexible fastener 10 improved according to the invention. The flexible fastener 10 has a pair of free strap ends 12 and 14. The strap ends 12 and 14 are mutually engageable with each other in overlapping fashion such that the strap end 14 is an outer end having its terminal portion overlapping the corresponding terminal portion of the inner strap end 12. As illustrated in FIG. 2, the strap ends 12 and 14 are also totally disengageable from each other.

The inner strap end 12 has an outwardly facing contact surface 16 which, in the embodiment of FIGS. 1–2, is a pad of nylon pile formed with a multiplicity of nylon loops of the type depicted, for example, in U.S. Pat. No. 2,717,437. The outer strap end 14 has an inwardly facing contact surface 18 which bears a multiplicity of resilient, flexible hooks of the type likewise described in U.S. Pat. No. 2,717,437. The flexible hooks of the contact surface 18 are releasably engageable with the loops of the pile when the contact surfaces 16 and 18 are pressed together in overlapping fashion. FIG. 1 illustrates the contact surfaces 16 and 18 partially pressed together during an intermediate stage of separation.

As best illustrated in FIG. 2, the contact surface 16 terminates short of the free extremity 20 of the inner strap end 12. The free extremity 20 of the inner end 12 has a tip or terminus 22, formed by merely folding over the transverse edge extremity 24 of the free strap end 12 and maintaining the fold as indicated by stitching 24 which extends transversely across the strap end 12 proximate to the free extremity 20 thereof. The interior surface 28 of the inner strap end 12 is formed of smooth nylon, so that the outwardly facing surface of the tip 22 is likewise constructed of smooth nylon and is not engageable by the contact surface 18 of the outer strap end 14. The tip 22 is preferably at least about one quarter of an inch in width as measured by the distance between the free extremity 20 and the transverse edge extremity 24.

The extremity of the outer strap end 14 is likewise folded over and stitched to form a gripping tab 30. When the strap ends 12 and 14 are disposed in complete juxtaposition relative to each other such that the contact surfaces 16 and 18 are engaged throughout their areas of mutual contact, the tab 30 provides a convenient grip which may be easily seized between the thumb and forefinger of a user and pulled away from the inner strap 12. The strap ends 12 and 14 are shown in a position of partial disengagement in FIG. 1.

The releasable fastener 10 is normally secured at some intermediate location 32 to some base structure to which it is affixed. As illustrated in FIG. 2, the strap ends 12 and 14 are disengageable from each other, but they are also constructed with their respective contact surfaces 16 and 18 thereon such that they are adapted for mutually releasable engagement when disposed in facing, overlapping arrangement in contact with each other. In such a condition they form a loop as illustrated in FIG. 1.

To open the loop of FIG. 1, the user merely grips the tab 30 between thumb and forefinger and pulls the tab 30 away from the strap end 12. As in conventional releasable, flexible fasteners of this type, the strap end 12 will tend to follow the retreating outer strap end 14 to a certain extent However, unlike conventional releasable fasteners of this type, the tip 22 of the inner strap end 12 will not continue to follow the withdrawing strap end 14, and thus remain engaged with the contact surface 18. To the contrary, as the strap end 14 is drawn away from the strap end 12, the free extremity 20 of the inner strap end 12 tends to bear against the contact surface 18, and the tip 22 functions somewhat in the manner of a short lever so as to aid in prying away the last remaining mutually engaged hooks on the contact surface 18 from the loops of pile on the contact surface 16. With the improved flexible fastener 10 depicted in FIGS. 1 and 2, it is never necessary to employ two hands to separate the strap ends 12 and 14, as they are always separable utilizing the fingers of a single hand.

Figure 3:
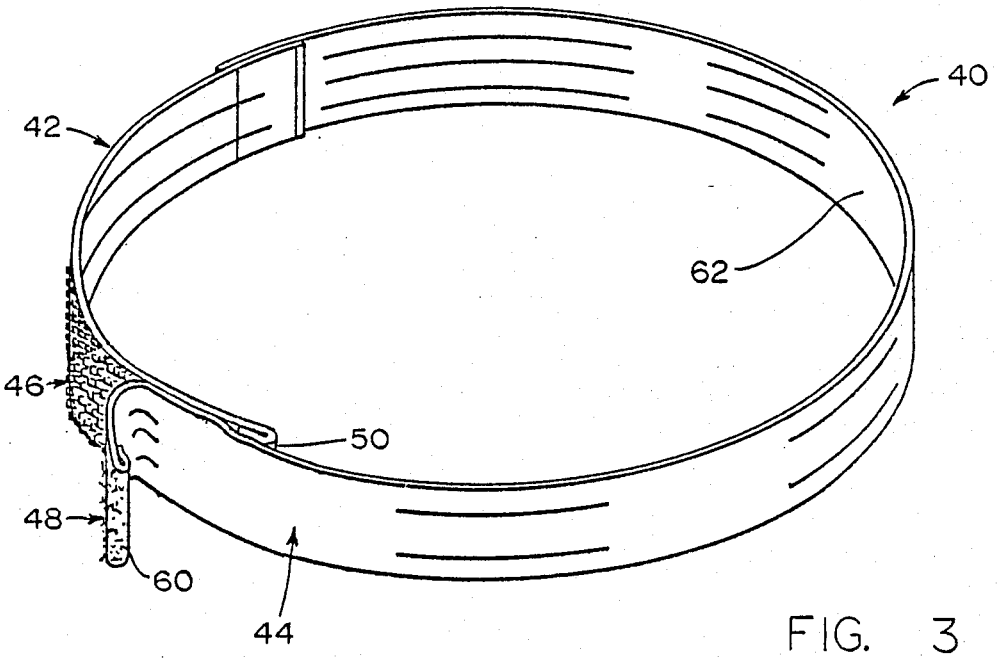
FIG. 3 is a perspective view showing an alternative embodiment of a releasable fastener according to the invention having strap ends that form an encircling loop.
Figure 4:
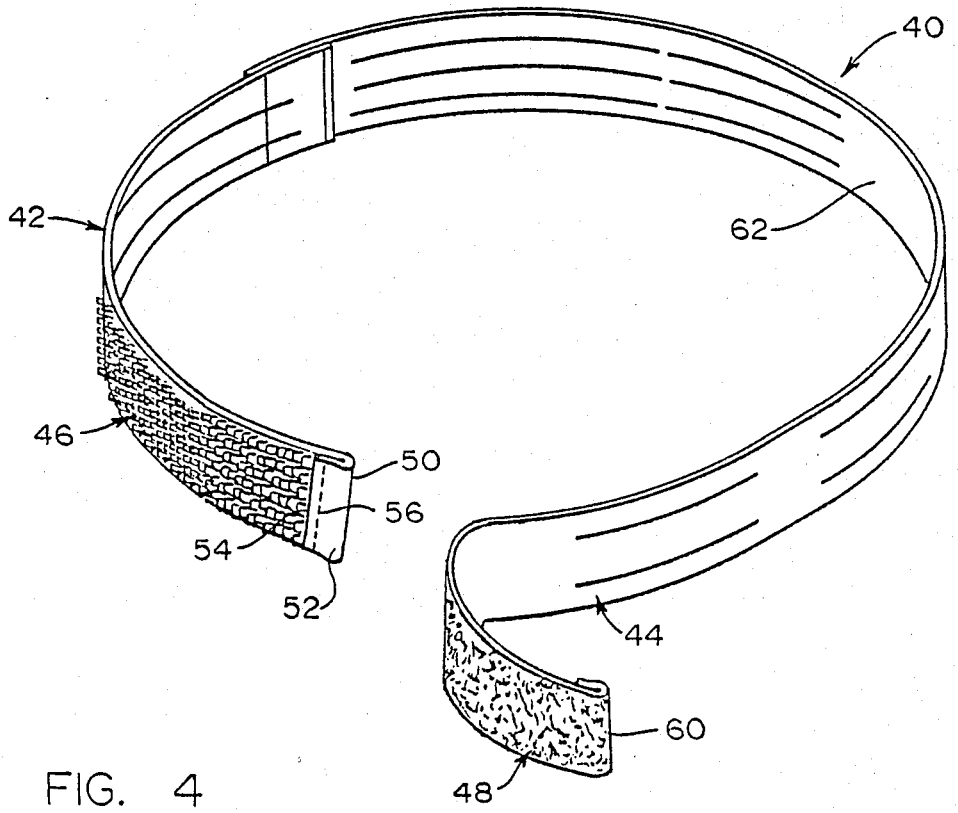
FIG. 4 illustrates the embodiment of FIG. 3 with the strap ends completely separated.

FIG. 3 illustrates an alternative embodiment of a releasable flexible fabric hook and loop fastener 40 having a pair of strap ends 42 and 44. The strap ends 42 and 44 are completely disengageable from each other as depicted in FIG. 4, but are also releasably securable together to form an encircling loop as depicted in FIG. 3. The inner strap end 42 has an outwardly facing contact surface 46 which does not extend the entire length of the inner strap end 42 to the free end extremity 50 thereof, but instead forms a tip or terminus 52. The tip 52 is likewise formed by folding over the edge extremity 54 a short distance. The fold is maintained by stitching indicated at 56. The width of the tip 52 is at least about one quarter of an inch from the free extremity 50 to the folded transverse edge extremity 54. The outer strap 44 has a gripping tab 60 which is formed in the same manner as the gripping tab 30 in the embodiment of FIGS. 1 and 2.

The releasable fastener 40 of FIGS. 3 and 4 is operated in the same manner as the releasable fastener 10. That is, the folded end tab 60 of the outer strap end 44 is gripped between thumb and forefinger when the contact surfaces 46 and 48 are pressed together in overlapping fashion. The releasable fastener 40 is normally anchored to some base structure at an intermediate location 62 between the free extremities 50 and 60 of the strap ends 42 and 44, respectively. When the folded tab 60 of the outer strap end 44 is pulled away from the contact surface 46, the resilient flexible hooks on the contact surface 46 will disengage from the loops of the pile of the contact surface 48. The relatively stiff end 52 formed by the fold in the strap end 42 aids in allowing the strap ends 42 and 44 to become completely separated by drawing only upon the gripping tab 60, and without the necessity for touching or otherwise constraining movement of the strap end 42 with the other hand.

Undoubtedly, numerous variations and modifications of the invention will become readily apparent to those familiar with releasable flexible fabric hook and loop fasteners. For example, while the strap ends of the embodiments depicted have been illustrated as being formed of separate lengths of fabric secured together at intermediate locations, it is to be understood that a loop could be formed from a single length of fabric having inner and outer strap ends at its opposite extremities. Accordingly, the scope of the invention should not be construed as limited to the specific embodiments of the invention depicted and described, but rather is defined in the claims appended.

I claim:

1. A releasable fastener having inner and outer strap ends releasable securable together to form an encircling loop and wherein said inner strap end has an edge extremity folded outwardly and back upon itself where it is secured to form a return which defines a tip of double thickness at least one quarter of an inch wide and an outwardly facing contact surface which terminates at said tip of said inner strap end, and said outer strap end also has an edge extremity folded back upon itself in a return which defines a gripping tab of double thickness which is seizable between the thumb and forefinger of a single hand and said outer strap end has an inwardly facing contact surface, and one of said contact surfaces bears a multiplicity of projecting flexible hooks and the other of said contact surfaces bears a flexible looped pile, and said contact surfaces are positionable in juxtaposition, whereby said hooks are releasably engageable in said pile and said contact surfaces are separable using the fingers of a single hand to peel back said outer strap from said inner strap such that said tip of said inner strap acts as a short lever which aids in prying apart the last remaining mutually engaged hooks and loops of said contact surfaces.

* * * * *